US009291065B2

(12) United States Patent
Muller et al.

(10) Patent No.: US 9,291,065 B2
(45) Date of Patent: Mar. 22, 2016

(54) GAS TURBINE INCLUDING BELLYBAND SEAL ANTI-ROTATION DEVICE

(71) Applicants: Christopher J Muller, Oviedo, FL (US); David J Mitchell, Oviedo, FL (US); Michael J Olejarski, Merrit Island, FL (US)

(72) Inventors: Christopher J Muller, Oviedo, FL (US); David J Mitchell, Oviedo, FL (US); Michael J Olejarski, Merrit Island, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 484 days.

(21) Appl. No.: 13/789,802

(22) Filed: Mar. 8, 2013

(65) Prior Publication Data

US 2014/0255169 A1 Sep. 11, 2014

(51) Int. Cl.
*F01D 11/00* (2006.01)
*F01D 5/06* (2006.01)

(52) U.S. Cl.
CPC ..... *F01D 11/003* (2013.01); *F01D 5/06* (2013.01); *F01D 11/005* (2013.01)

(58) Field of Classification Search
CPC ..... F01D 11/00; F01D 11/003; F01D 11/005; F01D 11/006; F01D 11/008; F01D 5/06; F16J 15/02; F16J 15/062; F16J 15/067; F16J 15/0887
USPC ..... 415/230, 231, 199.5, 110, 173.1–173.7; 416/198 R–198 A, 221; 277/416, 421
See application file for complete search history.

(56) References Cited

U.S. PATENT DOCUMENTS

| | | | | |
|---|---|---|---|---|
| 5,320,488 | A | 6/1994 | Meade et al. | |
| 5,865,600 | A | 2/1999 | Mori et al. | |
| 5,967,746 | A | 10/1999 | Hagi et al. | |
| 6,089,827 | A | 7/2000 | Ichiryu et al. | |
| 6,315,301 | B1 | 11/2001 | Umemura et al. | |
| 7,470,113 | B2 | 12/2008 | Tran et al. | |
| 7,549,845 | B2 | 6/2009 | Uwami et al. | |
| 7,581,931 | B2 | 9/2009 | Shaefer et al. | |
| 2005/0265846 | A1 | 12/2005 | Przytulski et al. | |
| 2006/0239814 | A1 | 10/2006 | Uwami et al. | |
| 2009/0148279 | A1 | 6/2009 | Shaefer et al. | |
| 2009/0191050 | A1 | 7/2009 | Nereim et al. | |
| 2010/0074731 | A1 | 3/2010 | Wiebe et al. | |
| 2010/0074732 | A1* | 3/2010 | Marra et al. | 415/173.4 |
| 2015/0198055 | A1* | 7/2015 | Mitchell | B23K 31/02 415/110 |

* cited by examiner

*Primary Examiner* — Jesse Bogue
*Assistant Examiner* — Laert Dounis

(57) ABSTRACT

A turbine including a plurality of stages, each stage including a rotatable disk and blades carried thereby. An annular gap defined between a pair of adjacent rotatable disks. A sealing band is located in opposing sealing band receiving slots formed in the adjacent disks to seal the annular gap, the sealing band including band engagement structure. A disk engagement structure is defined in the pair of adjacent rotatable disks. The disk engagement structure extends axially into the pair of adjacent rotatable disks and circumferentially aligns with the band engagement structure. A clip member is positioned in engagement with the sealing band through the band engagement structure and in engagement with the pair of adjacent rotatable disks through the disk engagement structure. The clip member restricts movement of the sealing band in only a circumferential direction of the slots.

19 Claims, 3 Drawing Sheets

GAS TURBINE INCLUDING BELLYBAND SEAL ANTI-ROTATION DEVICE

FIELD OF THE INVENTION

This invention relates in general to seals for multistage turbomachines and, more particularly, to an anti-rotation structure for a seal provided between adjoining disks in a multistage turbomachine.

BACKGROUND OF THE INVENTION

In various multistage turbomachines used for energy conversion, such as turbines, a fluid is used to produce rotational motion. In a gas turbine, for example, a gas is compressed through successive stages in a compressor and mixed with fuel in a combustor. The combination of gas and fuel is then ignited for generating combustion gases that are directed to turbine stages to produce the rotational motion. The turbine stages and compressor stages typically have stationary or non-rotary components, e.g., vane structures, that cooperate with rotatable components, e.g., rotor blades, for compressing and expanding the operational gases.

The rotor blades are typically mounted to disks that are supported for rotation on a rotor shaft. Annular arms extend from opposed portions of adjoining disks to define paired annular arms. A cooling air cavity is formed on an inner side of the paired annular arms between the disks of mutually adjacent stages, and a labyrinth seal may be provided on the inner circumferential surface of the stationary vane structures for cooperating with the annular arms to effect a gas seal between a path for the hot combustion gases and the cooling air cavity. The paired annular arms extending from opposed portions of adjoining disks define opposing end faces located in spaced relation to each other. Typically the opposing end faces may be provided with a slot for receiving a sealing band, known as a "bellyband seal", which bridges the gap between the end faces to prevent cooling air flowing through the cooling air cavity from leaking into the path for the hot combustion gases. The sealing band may be formed of multiple segments, in the circumferential direction, that are interconnected at lapped or stepped ends.

When the sealing band comprises plural segments positioned adjacent to each other, in the circumferential direction, the sealing bands may shift circumferentially relative to each other. Shifting may cause one end of a sealing band segment to increase the overlap with an adjacent segment, while the opposite end of the sealing band segment will move out of engagement with an adjacent segment, opening a gap for passage of gases through the sealing band. Hence, it is typically desirable to provide a mechanism for preventing relative circumferential shifting of the sealing band segments.

SUMMARY OF THE INVENTION

In accordance with an aspect of the invention, a turbine is provided comprising a plurality of stages, each stage comprising a rotatable disk and blades carried thereby. At least one pair of adjacent rotatable disks define an annular gap therebetween and have respective opposing sealing band receiving slots aligned with the gap. A sealing band is located in the opposing sealing band receiving slots to seal the annular gap, and the sealing band comprises band engagement structure. Disk engagement structure is defined in the pair of adjacent rotatable disks. The disk engagement structure extends axially into the pair of adjacent rotatable disks and circumferentially aligns with the band engagement structure.

A clip member is positioned in engagement with the sealing band through the band engagement structure and in engagement with the pair of adjacent rotatable disks through the disk engagement structure. The clip member restricts movement of the sealing band in only a circumferential direction of the slots.

The band engagement structure may comprise a pair of circumferentially aligned band notches in opposing edges of the sealing band.

The clip member may comprise a U-shaped member having a pair of legs, each leg including an outer end extending through one of the band notches. The sealing band may include opposing radially outer and inner sides, and an attachment structure may be provided affixing the outer ends of the legs to the radially outer side of the sealing band. Further, the attachment structure may include a welded joint between the outer ends of the legs and the radially outer side of the sealing band.

The clip member may include a base portion extending between the legs adjacent to the radially inner side of the sealing band, the base portion having a length no greater than a distance between the legs.

The base portion may have a thickness in the radial direction that is about equal to a thickness of the sealing band.

The sealing band may include a hole located between the opposing edges of the sealing band, and a post may be affixed to the base portion and extend through the hole for retaining the clip member in engagement with the sealing band prior to the attachment structure affixing the outer ends of the legs to the sealing band.

The disk engagement structure may comprise a pair of circumferentially aligned disk notches in the pair of adjacent rotatable disks.

The clip member may comprise a substantially planar base portion and two legs, the legs cooperating with the band engagement structure and the disk engagement structure to prevent rotation of the sealing band. The clip member may be formed so as not to extend radially beyond the disk engagement structure.

In accordance with a further aspect of the invention, a turbine is provided comprising a plurality of stages, each stage comprising a rotatable disk and blades carried thereby. At least one pair of adjacent rotatable disks define an annular gap therebetween and have respective opposing sealing band receiving slots aligned with the gap. A sealing band is located in the opposing sealing band receiving slots to seal the annular gap. The sealing band defines opposing radially outer and inner sides and has opposing edges, and band notches are formed in the edges to define a band engagement structure. A pair of circumferentially aligned disk notches are formed in the pair of adjacent rotatable disks to define a disk engagement structure. The disk notches extend axially into the pair of adjacent rotatable disks and are circumferentially aligned with the band notches. A U-shaped clip member is provided including a base portion and a pair of legs. The base portion is positioned in engagement with the radially inner side of the sealing band and the legs include outer ends extending through the band notches and engaged in the disk notches to prevent movement of the sealing band in a circumferential direction within the slots. The base portion defines a width dimension in a circumferential direction of the slots that is no greater than a width dimension of the disk notches in the circumferential direction.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
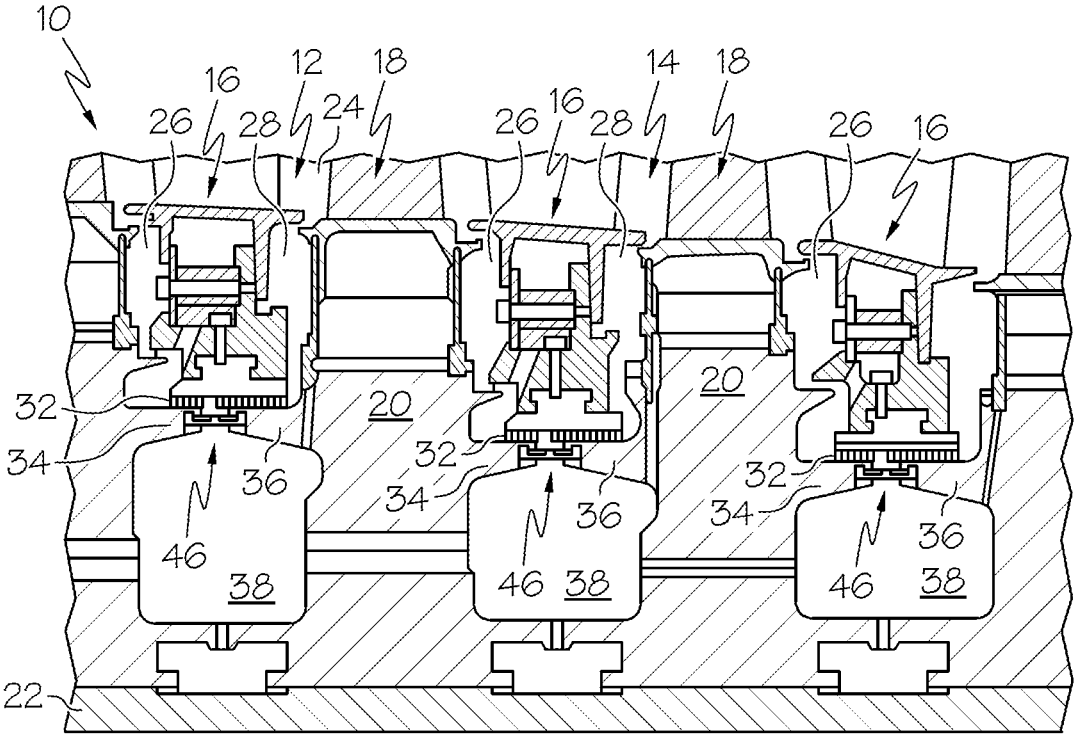
FIG. 1 is a diagrammatic section view of a portion of a gas turbine engine.

Referring to FIG. 1, a portion of a turbine engine 10 is illustrated diagrammatically including adjoining stages 12, 14, each stage 12, 14 comprising an array of stationary vane assemblies 16 and an array of rotating blades 18, where the vane assemblies 16 and blades 18 are positioned circumferentially within the engine 10 with alternating arrays of vane assemblies 16 and blades 18 located in the axial direction of the turbine engine 10. The blades 18 are supported on rotor disks 20 secured to adjacent disks with spindle bolts 22. The vane assemblies 16 and blades 18 extend into an annular gas passage 24, and hot gases directed through the gas passage 24 flow past the vane assemblies 16 and blades 18 to remaining rotating elements.

Disk cavities 26, 28 are located radially inwardly from the gas passage 24. Purge air is preferably provided from cooling gas passing through internal passages in the vane assemblies 16 to the disk cavities 26, 28 to cool blades 18 and to provide a pressure to balance against the pressure of the hot gases in the gas passage 24. In addition, interstage seals comprising labyrinth seals 32 are supported at the radially inner side of the vane assemblies 16 and are engaged with surfaces defined on paired annular disk arms 34, 36 extending axially from opposed portions of adjoining disks 20. An annular cooling air cavity 38 is formed between the opposed portions of adjoining disks 20 on a radially inner side of the paired annular disk arms 34, 36. The annular cooling air cavity 38 receives cooling air passing through disk passages to cool the disks 20.

Figure 2:
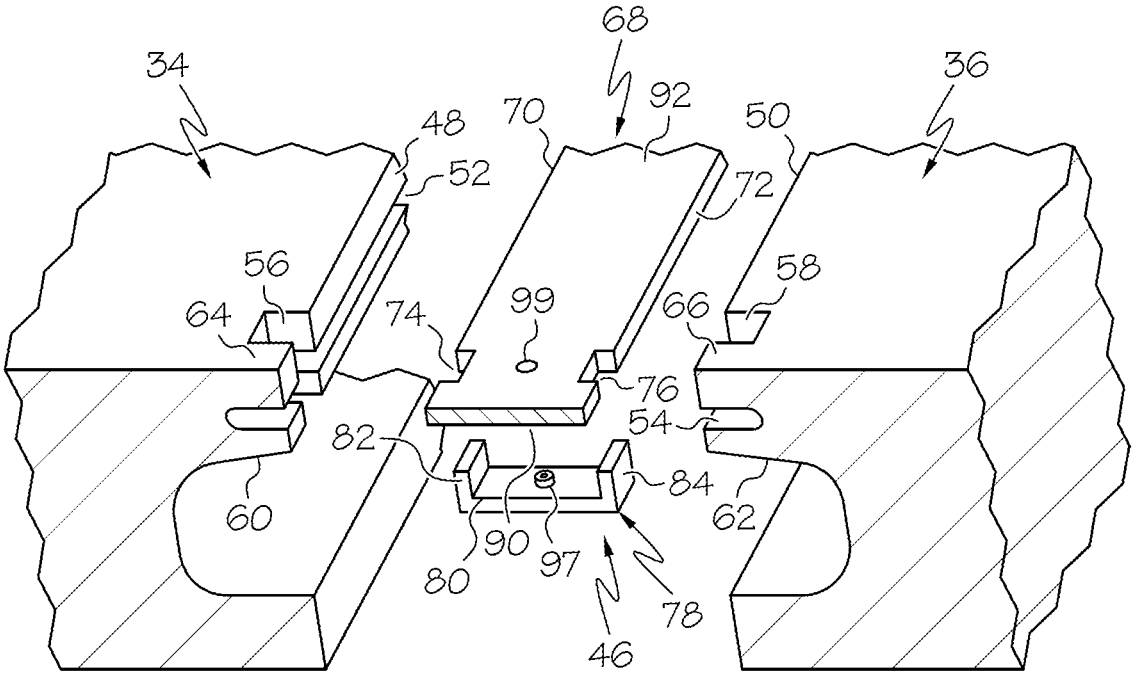
FIG. 2 is an exploded perspective view illustrating an anti-rotation structure in association with a sealing band and adjacent rotatable disk arms.
Figure 3:
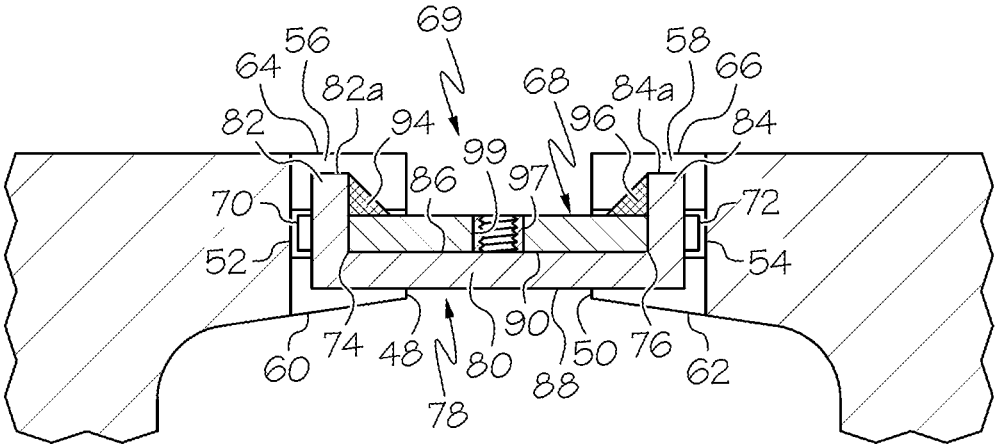
FIG. 3 is a cross-sectional view of the anti-rotation structure assembled to the sealing band by a welded attachment structure.

Referring further to FIGS. 2 and 3, the disk arms of two adjoining disks 20 are illustrated for the purpose of describing the sealing band assembly 46 of the present invention, it being understood that the disks 20 and associated disk arms 34, 36 define an annular structure extending the full circumference about the rotor centerline. The disk arms 34, 36 define respective opposed end faces 48, 50 located in closely spaced relation to each other. A circumferentially extending slot 52, 54 is formed in the respective end faces 48, 50, wherein the slots 52, 54 are radially aligned with an annular gap 69 (FIG. 3) defined between the end faces 48, 50. In addition, the disk arms 34, 36 a disk engagement structure comprising respective disk notches or radial openings 56, 58 extending from a radially inner surface 60, 62 toward a radially outer surface 64, 66 of respective disk arms 34, 36, and extending axially inwardly from the end faces 48, 50 and intersecting the slots 52, 54.

Referring to FIG. 2, the sealing band assembly 46 includes a sealing band 68 forming a circumferentially extending bellyband seal. The sealing band 68 includes opposing sealing band edges 70, 72 which are positioned within the respective slots 52, 54 (FIG. 3) defined in the opposed end faces 48, 50. The sealing band 68 spans the annular gap 69 between the end faces 48, 50 and defines a seal for preventing or substantially limiting flow of gases between the cooling air cavity 38 and the disk cavities 26, 28. The sealing band 68 additionally includes a band engagement structure comprising a pair of band notches 74, 76 formed in the opposing sealing band edges 70, 72 for alignment with the radial openings 56, 58 formed in the disk arms 34, 36.

It may be noted that the radial openings 56, 58 in the disk arms 34, 36 are typically provided for engagement with a prior art anti-rotation structure (not shown) associated with a bellyband seal. For example, a known anti-rotation structure could be a block structure attached to the bellyband seal and extending axially into the openings 56, 58, where engagement between the anti-rotation structure and sides of the openings 56, 58 prevents or limits circumferential movement of the bellyband seal or segments of the seal. Such an anti-rotation structure is illustrated in U.S. Pat. No. 7,581,931, which patent is incorporated herein by reference. As is described below, the present invention provides an anti-rotation device capable of utilizing the existing disk arm structure, including utilizing the radial openings 56, 58 to prevent rotation of the sealing band 68.

Figure 6:
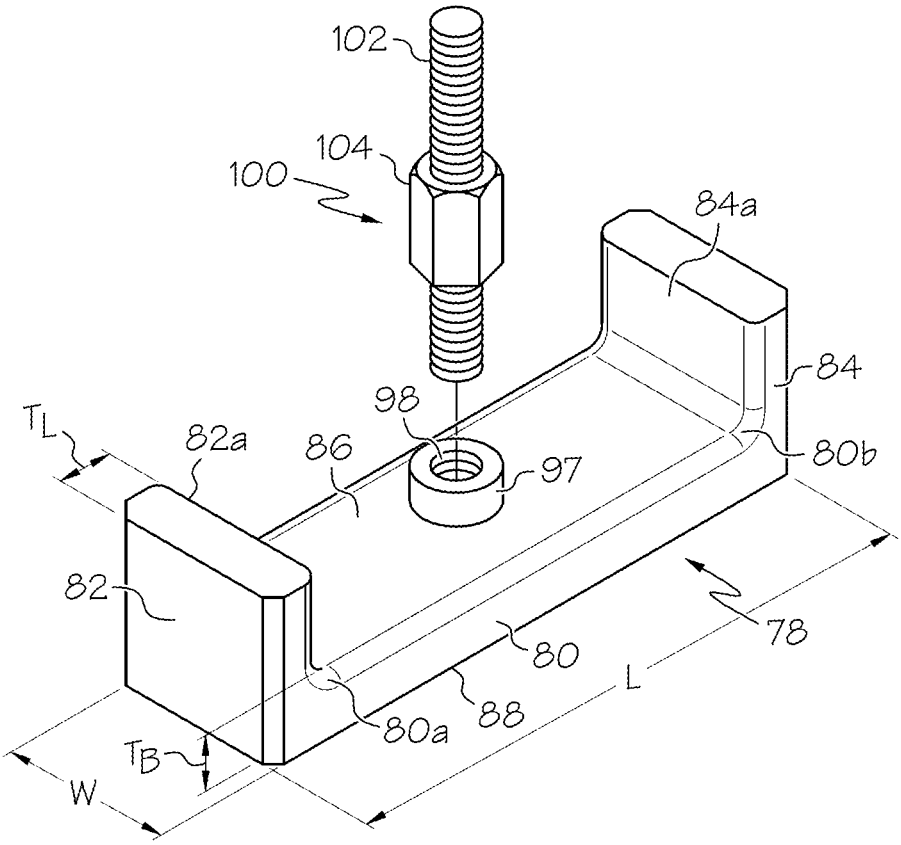
FIG. 6 is a perspective view of a clip member with a mounting structure of the anti-rotation structure.

Referring to FIGS. 2 and 6, in accordance with an aspect of the invention, the sealing band assembly 46 includes a U-shaped anti-rotation body or clip member 78. The clip member 78 includes a base portion 80 having opposing ends 80*a*, 80*b* and a pair of legs 82, 84 formed integral with the respective base portion ends 80*a*, 80*b*. The base portion 80 is a rectangular planar member having an outer side 86 and an inner side 88, and the legs 82, 84 extend outward from the outer side 86 perpendicular to the base portion 80.

As seen in FIG. 3, the clip member 78 is assembled to an inner side 90 of the sealing band 68 with the legs 82, 84 positioned through the band notches 74, 76. In particular, the base portion 80 is positioned with its outer side 86 engaged against the inner side 90 of the sealing band 68, and with outer ends 82*a*, 84*a* of the legs 82, 84 extending radially outwardly from an outer side 92 of the sealing band 68. The clip member 78 is held in position on the sealing band 68 by means of an attachment structure in the form of weld joints 94, 96 formed at junctions between the legs 82, 84 and the outer side 92 of the sealing band 68.

In accordance with an aspect of the invention, it has been noted that prior anti-rotation assemblies incorporating an anti-rotation body welded to a sealing band formed stresses at the weld joint resulting in cracking and possible failure at the weld joint. It is believed that the mass of the anti-rotation body, with an associated substantial centripetal load applied to the anti-rotation body during operation of the engine, is one factor that has contributed to failure of weld joints in anti-rotation assemblies. Further, prior welded anti-rotation bodies included an engagement between the anti-rotation body and inwardly facing surfaces of the rotor disk arms, such engagement providing a restriction on radial movement of the anti-rotation body with a resulting restriction on radial movement of the sealing band, which is believed to have further contributed to stresses at the weld joints. Consequently, an aspect of the present invention includes forming the clip member 78 with a low mass that is also free to move within the disk notches 56, 58.

The low mass and unrestrained radial movement of the present sealing band assembly 46 is embodied by the clip member 78 being formed to effectively cooperate within the disk notches 56, 58 to limit circumferential movement of the sealing band 68, while also having preferred dimensions to only limit movement in the circumferential direction with a minimum of mass in the clip member 78 to minimize centripetal loading association with the clip member 78.

As seen in FIG. 6, the legs 82, 84 have a thickness dimension, $T_L$, that is equal to or less than the axial depth of the notches 74, 76 into the sealing band 68, such that a length dimension, L, of the clip member 78 is no greater than, and may be less than, the axial width of the sealing band 68. Also, both the base portion 80 and the legs 82, 84 of the clip member 78 are formed with a width dimension, W, that is no greater than, and is preferably slightly less than, the circumferential width dimension of the disk notches 56, 58. Hence, the length and width dimensions of the clip member 78 ensure that the sealing band assembly 46 is dimensioned to provide clearance for radial and/or axial movement of the clip member 78 without binding within 1 the disk notches 56, 58.

In accordance with a particular aspect of the invention, the mass of the clip member 78 is minimized by forming a thickness dimension, $T_B$, of the body portion 80 that is substantially thin. For example, the thickness, $T_B$, of the body portion 80 is preferably substantially equal to the thickness dimension, $T_L$, of the legs 82, 84. Further, the thickness, $T_B$, of the body portion 78 may be close to, or slightly greater than, the thickness of the sealing band 68, such as within about 25% of the thickness of the sealing band 68. Accordingly, the thickness of the body portion 80 is preferably sufficient to provide adequate rigidity to the clip member 78 extending across the width of the sealing band 68 between the legs 82, 84, while minimizing the thickness to provide a low mass structure for coupling the legs 82, 84.

As may be seen in FIG. 3, the end portions of the body portion 80 of the clip member 78 that extend axially past the disk arm end faces 48, 50, i.e., into the disk notches 56, 58, are located entirely within the disk notches 56, 58 in the radial direction inwardly from the sealing band 68. Similarly, the legs 82, 84 are preferably dimensioned to provide a predetermined or minimal extension in the radial direction outwardly from the outer side 92 of the sealing band 68. Specifically, the outer ends 82*a*, 84*a* of the legs 82, 84 have a radial extent that is contained entirely within the disk notches 56, 58. It may be noted that no portion of the sealing band assembly 46 extends outwardly from the radially outer surfaces 64, 66 of the disk arms 34, 36 or into the gap 69 outwardly from the sealing band 68, such that the structure of the sealing band assembly 46 is protected from potential damage that may be caused by any loose components or debris in the area outwardly from the disk arms 34, 36.

Figure 4:
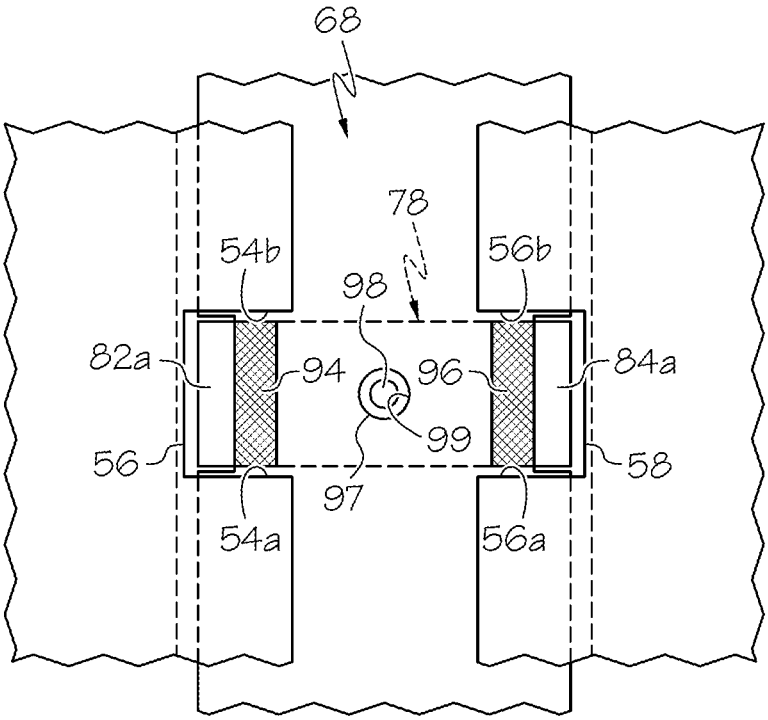
FIG. 4 is a plan view of the assembled anti-rotation structure, in position on the sealing band.

The radial extent of the legs 82, 84 is sufficient to provide a structure for cooperating with the 1 circumferential sides 54*a*, 54*b* and 56*a*, 56*b* (FIG. 4) of the disk notches 56, 58 to limit circumferential movement of the sealing band 68 within the slots 52, 54. Additionally, the radial extent of the legs 82, 84 is sufficient to provide an adequate surface area for forming the weld joints 94, 96.

With respect to the configuration of the sealing band assembly 46 described herein, it may be noted that provision of the weld joints 94, 96 as the attachment structure between the clip member 78 and the sealing band 68 substantially ensures that no detachable components, such as fasteners, are available to detach and potentially become destructive debris within the engine. Further, in accordance with an aspect of the invention, the integrity of the connection between the clip member 78 and the sealing band at the opposing weld joints 94, 96 is facilitated by providing a low mass clip member structure configured to reduce or minimize stress at the normally vulnerable weld connections through the provision of a low mass component that restrains movement in only the circumferential direction of the slots 52, 54.

Figure 5:
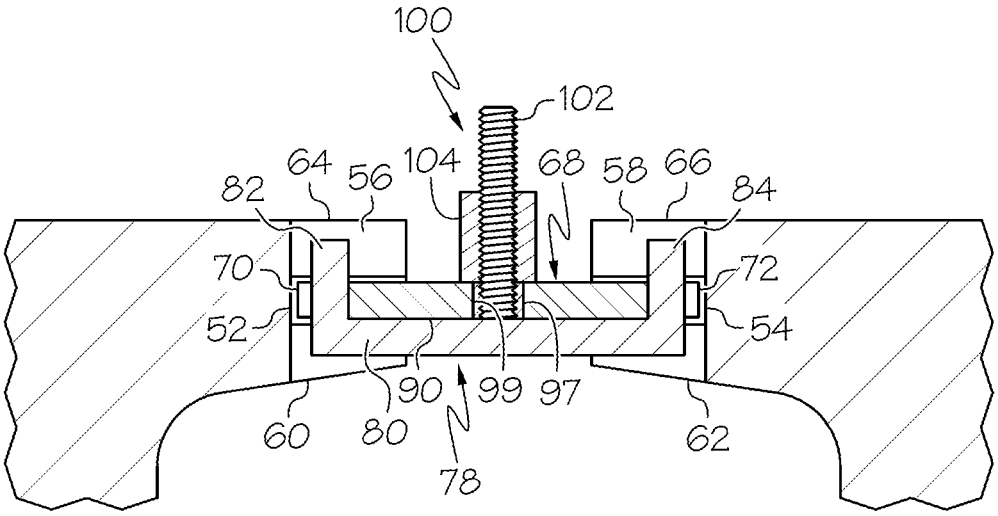
FIG. 5 is a cross-sectional view of the anti-rotation structure assembled to the sealing band prior to attachment by the welded attachment structure.

Referring to FIGS. 5 and 6, an aspect comprising a mounting structure associated with the clip member 78 is illustrated. During installation of the clip member 78 to the sealing band 68 it is necessary to retain the clip member 78 in position extending across the inner side 90 of the sealing band 68 prior to and during formation of the weld joints 94, 96. The mounting structure comprises a short cylinder 97 extending from the outer side 86 of the base portion 80 and defining a threaded aperture 98. The cylinder 97 is located centrally on the base portion 80 of the clip member 78, and the cylinder 97 is configured to extend at least partially into a hole 99 (FIG. 1) formed through the sealing band 68. The hole 99 is located centrally between the edges 70, 72 of the sealing band 68 and is aligned with the band notches 74, 76 in the circumferential direction.

The mounting structure additionally includes a post structure 100 configured for threaded engagement with the aperture 98. The post structure 100 includes a threaded shaft 102 and a nut member 104 in threaded engagement on the shaft 102. In a pre-installation configuration of the sealing band 68, the threaded shaft 102 may be positioned through the hole 99 in the sealing band 68 and threaded into the aperture 98 of the cylinder 97, and an outer end of the threaded shaft 102 is prevented from passing through the hole by the nut member 104. During installation of the sealing band 68 into the slots 52, 54, the clip member 78 may be rotated 90 degrees from the position depicted in FIG. 4 to permit movement and positioning of the sealing band 68 within the slots 52, 54 without the clip member 78 interfering with the disk arms 34, 36. Subsequently, the clip member 78 may be rotated to the position shown in FIG. 4, and the nut member 104 can be threaded down on the shaft 102 to bias the base portion 80 firmly into engagement with the sealing band 68 in order to ensure that the clip member 78 is in complete contact with the sealing band 68 and that there are no gaps formed during the welding process. Subsequent to formation of the welds 94, 96, the shaft 102 may be unthreaded from the aperture 98 and removed from the assembly formed by the sealing band 68 and clip member 78.

It may be understood that the engagement of the cylinder 97 within the hole 99 in the sealing band can facilitate alignment of the clip member 78 to the desired position on the sealing band 68 prior to the welding operation. Further, it should be noted that the cylinder 97 is preferably formed with a height that is no greater than the thickness of the sealing band 68 to avoid providing structure above the sealing band 68 that could potentially be impacted by debris in the area outwardly from the disk arms 34, 36.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine comprising:

a plurality of stages, each stage comprising a rotatable disk and blades carried thereby, at least one pair of adjacent rotatable disks defining an annular gap therebetween and having respective opposing sealing band receiving slots aligned with the gap; a sealing band assembly comprising a sealing band located in said opposing sealing band receiving slots to seal said annular gap, said sealing band comprising band engagement structure;

disk engagement structure defined in said pair of adjacent rotatable disks, said disk engagement structure extending axially into said pair of adjacent rotatable disks and circumferentially aligning with said band engagement structure;

wherein the sealing band assembly further comprises a clip member positioned in engagement with said sealing band through said band engagement structure and with said pair of adjacent rotatable disks through said disk engagement structure, said clip member restricting movement of said sealing band in a circumferential direction of said slots; and wherein the sealing band assembly is dimensioned to provide clearance for unrestrained radial movement of the clip member.

2. The turbine of claim 1, wherein said band engagement structure comprises a pair of circumferentially aligned band notches in opposing edges of said sealing band.

3. The turbine of claim 2, wherein said clip member comprises a U-shaped member having a pair of legs, each leg including an outer end extending through one of said band notches.

4. The turbine of claim 3, wherein said sealing band includes opposing radially outer and inner sides, and including an attachment structure affixing said outer ends of said legs to said radially outer side of said sealing band.

5. The turbine of claim 4, wherein said attachment structure includes a welded joint between said outer ends of said legs and said radially outer side of said sealing band.

6. The turbine in claim 4, wherein said clip member includes a base portion extending between said legs adjacent to said radially inner side of said sealing band, said base portion having a length no greater than a distance between said legs.

7. The turbine of claim 6, wherein said base portion has a thickness in the radial direction that is about equal to a thickness of said sealing band.

8. The turbine of claim 4, wherein said sealing band includes a hole located between said opposing edges of said sealing band, the hole being configured to receive a post affixed to said base portion and extending through said hole for retaining said clip member in engagement with said sealing band prior to said attachment structure affixing said outer ends of said legs to said sealing band.

9. The turbine of claim 1, wherein said disk engagement structure comprises a pair of circumferentially aligned disk notches in said pair of adjacent rotatable disks.

10. The turbine of claim 1, wherein said clip member comprises a substantially planar base portion and two legs, said legs cooperating with said band engagement structure and said disk engagement structure to prevent rotation of said sealing band.

11. The turbine of claim 10, wherein said clip member does not extend radially beyond said disk engagement structure.

12. A turbine comprising:

a plurality of stages, each stage comprising a rotatable disk and blades carried thereby, at least one pair of adjacent rotatable disks defining an annular gap therebetween and having respective opposing sealing band receiving slots aligned with the gap; a sealing band located in said opposing sealing band receiving slots to seal said annular gap, said sealing band defining opposing radially outer and inner sides and having opposing edges, and band notches formed in said edges to define a band engagement structure;

a pair of circumferentially aligned disk notches formed in said pair of adjacent rotatable disks to define a disk engagement structure, said disk notches extending axially into said pair of adjacent rotatable disks and circumferentially aligning with said band notches;

a U-shaped clip member including a base portion and a pair of legs, said base portion positioned in engagement with said radially inner side of said sealing band and said legs including outer ends extending through said band notches and engaged in said disk notches to prevent movement of said sealing band in a circumferential direction within said slots;

said base portion defines a width dimension in a circumferential direction of said slots that is no greater than a width dimension of said disk notches in said circumferential direction; and wherein the U-shaped clip member is dimensioned such that a clearance is formed between the disk notches and the respective legs of the U-shaped clip member that allows unrestrained radial movement of the U-shaped clip member.

13. The turbine in claim 12, wherein said base portion extends between said legs adjacent to said radially inner side of said sealing band, said base portion having a length no greater than a distance between said legs.

14. The turbine of claim 13, wherein said base portion has a thickness in the radial direction that is about equal to a thickness of said sealing band.

15. The turbine of claim 12, wherein said clip member does not extend radially beyond said disk engagement structure defined by said disk notches.

16. The turbine of claim 12, including an attachment structure affixing said outer ends of said legs to said radially outer side of said sealing band.

17. The turbine of claim 16, wherein said attachment structure includes a welded joint between said outer ends of said legs and said radially outer side of said sealing band.

18. The turbine of claim 16, wherein said sealing band includes a hole located between said opposing edges of said sealing band, the hole being configured to receive a retention structure comprising a post affixed to said base portion and extending through said hole for retaining said clip member in engagement with said sealing band prior to said attachment structure affixing said outer ends of said legs to said sealing band.

19. The turbine engine of claim 18, wherein said post includes a threaded portion permitting removal of at least a portion of said retention structure from engagement with said sealing band.

* * * * *